US005812421A

United States Patent [19]

Fujii et al.

[11] Patent Number: 5,812,421

[45] Date of Patent: Sep. 22, 1998

[54] SYSTEM FOR COOPERATIVELY OPERATING RIVER MANAGEMENT FACILITIES

[75] Inventors: Kenji Fujii; Koichi Homma; Fuminobu Komura, all of Yokohama; Kunio Takada, Ibaraki-ken, all of Japan

[73] Assignee: Hitachi, Ltd., Tokyo, Japan

[21] Appl. No.: 633,098

[22] Filed: Apr. 16, 1996

[30] Foreign Application Priority Data

Apr. 20, 1995 [JP] Japan ..... 7-094909

[51] Int. Cl.[6] ..... G01F 23/00

[52] U.S. Cl. ..... 364/510; 364/509; 364/565; 364/550; 364/138; 405/52

[58] Field of Search ..... 364/510, 509, 364/130, 138, 143, 144, 148–152, 191, 192, 194, 420, 442, 493, 495, 505, 506, 524, 550, 551.01, 565, 569, 570, 578, 579, 803; 73/861, 861.02, 861.03, 861.05, 861.08, 861.16, 861.356, 861.43, 861.44, 861.63, 195, 196, 197, 198, 204.14, 204.15, 290 R, 291, 301, 313; 405/52, 36, 92, 39; 340/870.01–870.03, 870.06, 870.07, 870.11, 870.16, 870.21, 870.28; 137/236.1, 386, 392; 210/170; 60/398; 290/42, 43, 52–54; 395/903, 906, 907, 914, 915, 928, 929–931; 707/1, 2, 10, 102, 104

[56] References Cited

U.S. PATENT DOCUMENTS

| | | | |
|---|---|---|---|
| 4,910,692 | 3/1990 | Outrame et al. | 364/420 |
| 5,160,216 | 11/1992 | Takada et al. | 405/92 |
| 5,342,144 | 8/1994 | McCarthy | 405/39 |
| 5,487,621 | 1/1996 | Takada et al. | 405/52 |
| 5,608,171 | 3/1997 | Hunter et al. | 73/861.63 |

FOREIGN PATENT DOCUMENTS

| | | |
|---|---|---|
| 3-184101 | 8/1991 | Japan . |
| 4-98502 | 3/1992 | Japan . |
| 4-160405 | 6/1992 | Japan . |
| 5-222760 | 8/1993 | Japan . |
| 6-332503 | 12/1994 | Japan . |

OTHER PUBLICATIONS

Japanese Society of Civil Engineers, 1971, "A Collection of Hydraulic Formulas", pp. 180–197, (No translation), (No date with month).

*Primary Examiner*—Emanuel Todd Voeltz
*Assistant Examiner*—Hal D. Wachsman
*Attorney, Agent, or Firm*—Fay, Sharpe, Beall, Fagan, Minnich & McKee

[57] ABSTRACT

A river management system for controllably operating devices of management facilities installed at pluralities of rivers and waterways to manage water volumes in a river network including the pluralities of rivers and waterways. The river management system includes an operation plan database for storing therein a plurality of sets of the contents of operations of the river management facility devices in the form of operation modes when the values of water levels, flow rates, precipitations and change rates thereof at a plurality of points of the river network satisfy predetermined conditions; an operation plan decider, when the values of water levels, flow rates, precipitations and change rates thereof at the points of the river network satisfy the predetermined conditions, for selecting one of the operation modes corresponding to the conditions and determining the operation contents of the river management facility devices; and a monitor/input section for inputting values of water levels, flow rates and precipitations of the points of the river network to the system.

18 Claims, 8 Drawing Sheets

FIG.4

104

| CONDITIONS | OPERATION MODE |
|---|---|
| 2.0m≦A WATER LEVEL<3.0m<br>0.4m/h≦A WATER LEVEL RISE RATE<0.8m/h<br>1.5m≦B WATER LEVEL<2.5m<br>0.4m/h≦B WATER LEVEL RISE RATE<0.8m/h | MODE 1 (FOR INDEPENDENT OPERATIONS OF FACILITIES) |
| 1.5m≦A WATER LEVEL<2.5m<br>0.8m/h≦A WATER LEVEL RISE RATE<br>1.0m≦B WATER LEVEL<2.0m<br>0.8m/h≦B WATER LEVEL RISE RATE | MODE 2 (FOR COOPERATIVE OPERATION OF FACILITIES 2-2 AND 2-4) |
| 1.5m≦A WATER LEVEL<2.5m<br>0.4m/h≦A WATER LEVEL RISE RATE<0.8m/h<br>1.0m≦B WATER LEVEL<2.0m<br>0.8m/h≦B WATER LEVEL RISE RATE<br>0.5m≦ C WATER LEVEL<1.5m<br>0.8m/h≦C WATER LEVEL RISE RATE | MODE 3 (FOR COOPERATIVE OPERATION OF FACILITIES 2-4 AND 2-6) |
| ..... | ..... |

FIG.5

501

| OPERATION MODE 1 |
| --- |
| MOVABLE FLASHBOARD 2-1 HEIGHT=2.0m,<br>PUMP START CONDITIONS OF DRAINAGE FACILITY 2-2: A WATER LEVEL>3.0m, A WATER LEVEL≦D WATER LEVEL<br>PUMP STOP CONDITIONS OF DRAINAGE FACILITY 2-2: A WATER LEVEL>2.0m, OR A WATER LEVEL>D WATER LEVEL<br>FULLY-OPENED WATER GATE OF DRAINAGE FACILITY 2-3,NO PUMP OPERATION<br>PUMP START CONDITIONS OF DRAINAGE FACILITY 2-4: B WATER LEVEL>2.5m, B WATER LEVEL≦E WATER LEVEL<br>PUMP STOP CONDITIONS OF DRAINAGE FACILITY 2-4: A WATER LEVEL>1.5m OR B WATER LEVEL>E WATER LEVEL<br>..... |
| OPERATION MODE 2 |
| MOVABLE FLASHBOARD 2-1 HEIGHT=1.5m,<br>PUMP START CONDITIONS OF DRAINAGE FACILITY 2-2: A WATER LEVEL>2.5m, A WATER LEVEL≦D WATER LEVEL<br>PUMP STOP CONDITIONS OF DRAINAGE FACILITY 2-2: A WATER LEVEL>1.5m OR A WATER LEVEL>D WATER LEVEL<br>FULLY-OPENED WATER GATE OF DRAINAGE FACILITY 2-3,NO PUMP OPERATION<br>PUMP START CONDITIONS OF DRAINAGE FACILITY 2-4: B WATER LEVEL>2.0m, B WATER LEVEL≦E WATER LEVEL<br>PUMP STOP CONDITIONS OF DRAINAGE FACILITY 2-4: A WATER LEVEL>1.0m OR B WATER LEVEL>E WATER LEVEL<br>..... |
| OPERATION MODE 3 |
| ..... |

502

FIG.6

105

| CURRENT CONDITION | 30-MINUTES AFTER |
|---|---|
| 1.6m≦A WATER LEVEL < 1.8m, 0.4m/h≦A WATER LEVEL RISE RATE < 0.8m/h | 1.8m≦A WATER LEVEL < 2.0m |
| 0.4m/h≦B WATER LEVEL RISE RATE < 0.8m/h 50mm≦G PRECIPITATION | 0.8m/h≦B WATER LEVEL RISE RATE |
| 2.5m≦A WATER LEVEL < 3.5m, 1.1m≦B WATER LEVEL < 1.5m | 1.1m≦B WATER LEVEL < 2.5m |
| A WATER LEVEL≦D WATER LEVEL, OPERATION IN OPERATION MODE 1 | 0.4m/h≦D WATER LEVEL CHANGE RATE, 2.0m≦A WATER LEVEL < 2.5m, 1.5m≦B WATER LEVEL < 2.0m |
| ..... | ..... |

SYSTEM FOR COOPERATIVELY OPERATING RIVER MANAGEMENT FACILITIES

BACKGROUND OF THE INVENTION

1. Field of the Invention

The present invention relates to river management systems for a river network including pluralities of rivers and waterways and more particularly, to a river management system for controllably operating devices in river management facilities to manage the volumes or quantities of water in a river network of increasing area range and complexity.

2. Description of the Related Art

One prior art method for operating the devices of river management facilities is a method for operating an underground drainage system wherein drainage water is discharged into an underground drainage canal via shafts from various drainage ways including small rivers. Thus, the drainage water accumulated or stored in the underground drainage canal is properly discharged into a large-scale river at the ground level from an underground drainage facility installed at a terminal end of the underground drainage canal, as disclosed, e.g., in JP-A-5-222760.

In this case, when it is anticipated that the drainage water exceeding the water pumping-up capability of the underground drainage facility flows into the underground drainage canal, the flow-in quantity of drainage water is adjusted by operating the variable flashboard provided at a driving channel leading from the drain way to the vertical shaft. Further, when an increase in the water of the drain way is expected, the drainage water of the drain way is preferentially guided into the underground drainage canal, the water level of the drainage canal at the drainage facility is increased up to a pump-operable lowest level, and then the pump is pre-started and put in its wait mode for preparation of abrupt flow-in.

As shown in the above prior art technique, in a field of river management, small-scale rivers, which are susceptible to flood damage, such as drain ways or rivers whose beds are higher than neighboring plains are connected to a large-scale river via drain ways or underground drainage canals to cause the drainage water of the small-scale rivers to flow into the large-scale river. Thus, it is possible to suitably adjust the amount of water in small-scale rivers.

Recent increase in the pavement percentage of big cities, however, tends to increase the flow-out quantity of rain water and correspondingly to increase the quantity of river water. This results in that drainage canals and driving channels for realization of interchange of water between rivers are newly made so that a river network becomes increasingly complicated and broadened in its area range. Therefore, when the respective river management facilities are independently operated without their cooperative management as in the prior art, the following problems arise.

(1) The water pumping-out ability of a pump usually depends on the water level of a river as its drainage target. In other words, the higher the water level is the lower the pumping-out ability is. For this reason, when a pump in a drainage facility positioned upstream of a river discharges a large quantity of water and thus the water level of the river downstream thereof rises, a drainage facility located at the downstream end of the river cannot handle a total quantity of flow-in water coming from other rivers and drainage canals into the river, thus dangerously increasing the water levels of these rivers and drainage canals.

(2) Since the respective river management facilities are independently operated without their cooperative management, there occurs such a situation that the water once discharged from a river is again returned to the upstream-side river at the downstream side of the downstream-side river, that is, uneconomical water transportation. Further, when increase in tide level causes water of the river to barely flow into the sea, there is formed such a water loop that the once transported water returns to the initial location, thus deteriorating an economy of operation in the river management facilities.

SUMMARY OF THE INVENTION

It is therefore an object of the present invention to provide a technique for realizing automatic determination of operations in respective river management facilities to manage quantities of water in rivers included over a wide area of a complicated river network.

Another object of the present invention is to provide a technique for enabling previous confirmation of a result of operations of river management facilities.

Typical features of the present invention are as follows.

In accordance with an aspect of the present invention, there is provided a river management system for controllably operating devices of management facilities installed at pluralities of rivers and waterways to manage water volumes in a river network including the pluralities of rivers and waterways; which system comprises an operation plan database for storing therein a plurality of sets of conditions of values of water levels, flow rates and precipitations at a plurality of points in the river network and contents of corresponding operations of the river management facility devices; monitor/input means for detecting the water levels, flow rates and precipitations at the plurality of points of the river network, converting the detected values to digital values and then inputting the digital values to the system; and operation plan decider means for determining and displaying the operation contents of the river management facility devices on the basis of the values of the water levels, flow rates and precipitations at the plurality of points of the river network input from the monitor/input means and on the basis of the operation plan database.

The river management system may include device control means for controlling the devices of the river management facilities according to the operation contents determined by the operation plan decider means.

Further, the river management system may include a state transition database for storing therein a plurality of sets of the values of water levels, flow rates and precipitations at the plurality of points of the river network, the operation contents of the river management facility devices, and values of water levels and flow rates at the plurality of points of the river network after passage of a predetermined time; and state transition predictor means for researching the state transition database on the basis of the values of water levels, flow rates and precipitations at the plurality of points of the river network and on the basis of the operation contents of the river management facility devices to predict values of the water levels and flow rates after passage of a predetermined time.

BRIEF DESCRIPTION OF THE DRAWINGS

FIG. 4 shows a part of an operation plan database for use in the river management system;

FIG. 5 is a part of a table showing relationships between operation modes and operations of river facilities associated therewith;

FIG. 6 shows a part of the state transition database for use in the river management system;

DESCRIPTION OF THE PREFERRED EMBODIMENTS

Figure 1:
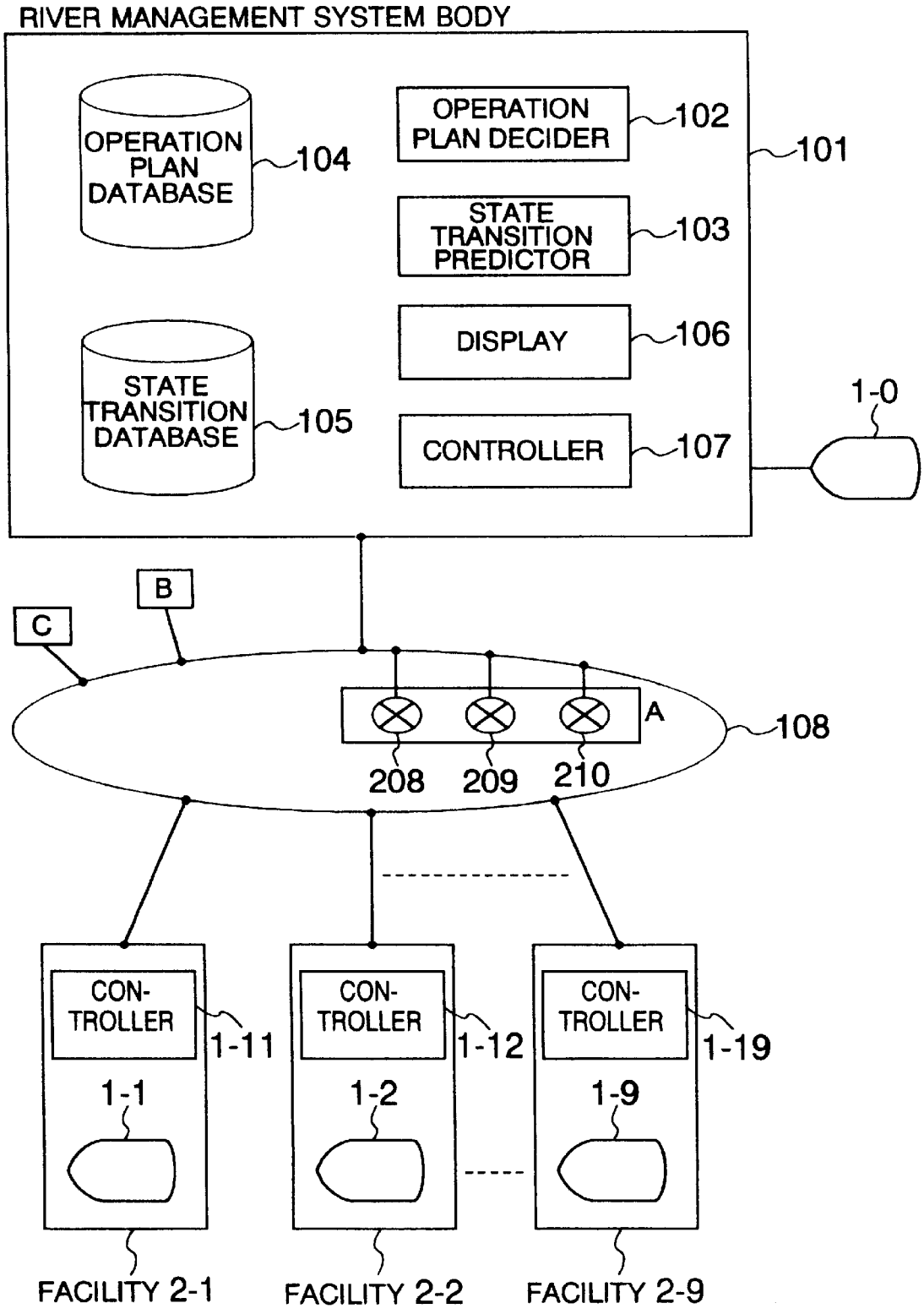
FIG. 1 is a schematic arrangement of a network embodying a river management system in accordance with an embodiment of the present invention.

The present invention will be explained in detail in conjunction with an embodiment shown in the accompanying drawings. In all the drawings for explaining the embodiment, parts having the same functions are denoted by the same reference numerals or symbols and explanation thereof is omitted to avoid repetition.

Referring first to FIG. 1, a river management system includes a river management system body 101; a network 108 such as a telephone network or a private line having therein water level indicators 208, flow meters 209 and rain gauges 210 (which are illustrated only for the observation point A in the drawing) installed at respective observation points A, B, C, . . . ; and a plurality of river management facilities 2-1 to 2-9. The river management facilities are connected to the river management system body 101 via the network 108.

The river management system body 101 has an operation plan database 104, a state transition database 105, an operation plan decider 102, a state transition predictor 103, a display 106, and a controller 107. The river management system body 101 comprises a computer which is equipped with a network connector, a signal input/output unit and a console 1-0. The operation plan database 104 and state transition database 105 are stored in an external memory or a main memory of the computer, while the operation plan decider 102, state transition predictor 103, display 106 and controller 107 are implemented by an arithmetic operation processing unit of the computer and by a software program executed by the arithmetic operation processing unit.

The water level indicator 208, flow meter 209 and rain gauge 210 in the form of sensors at each observation point measure a water level, flow rate and rainfall (quantity of precipitation) to be subjected to an analog-to-digital conversion, sent to the river management system body 101 via the network 108 and then stored in the main memory, respectively.

The river management facilities 2-1 to 2-9 have terminals 1-1 to 1-9 through which data are input and output from and to the river management system body 101 and are displayed, respectively. Also included in the river management facilities 2-1 to 2-9 are controllers 1-11 to 1-19 which act to receive signals from the river management system body 101 to control the associated facility devices.

Figure 2:
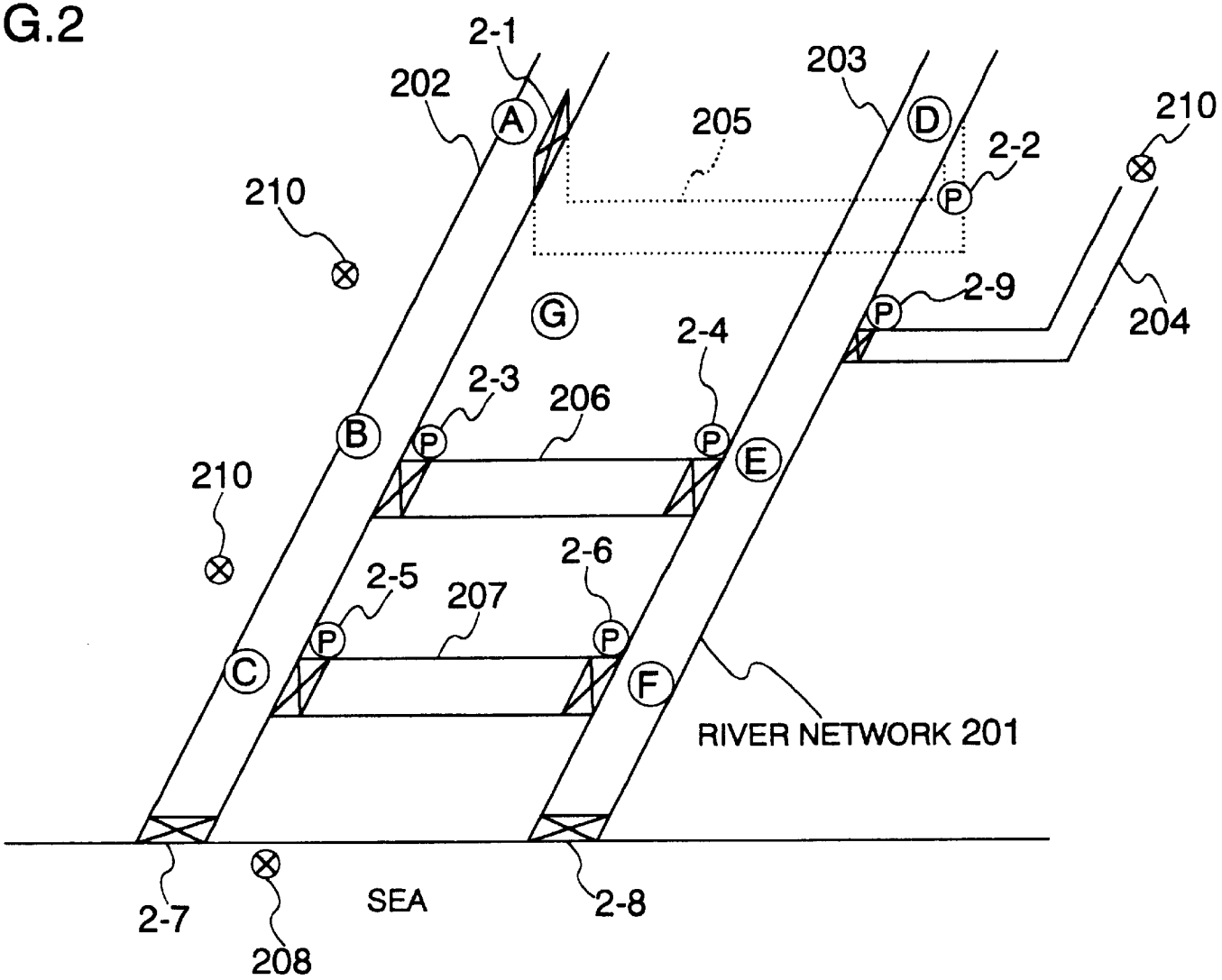
FIG. 2 shows a river network to which the river management system of the present embodiment is applied.

As shown in FIG. 2, a river network 201 to be managed by the river management system of the present embodiment includes a river 202, a river 203, a drain way 204, an underground drainage canal 205, and drainage canals 206 and 207. Installed at the points A to F in the river network 201 are the water level indicators 208 flow meters 209 and rain gauges 210 which measure the states of the river network 201 respectively. Also installed in the river network 201 are a river management facility 2-1, an underground drainage facility 2-2, drainage facilities 2-3 to 2-6, gates 2-7 and 2-8, and a drainage facility 2-9 as river management facility means for management of the river network 201.

When the height of a movable flashboard 2-1 as the river management facility is adjusted, a suitable amount of water at the time of a rise of the river 202 falls into the underground drainage canal 205, while the drainage facility 2-2 pumps up the water stored in the underground drainage canal 205 into the river 203.

Interchange of water between the rivers 202 and 203 is realized by controlling the drainage facilities 2-3 and 2-4 provided at both ends of the drainage canal 206 connected between the rivers 202 and 203. For example, when it is desired to transport water from the river 202 to the river 203, a gate of the drainage facility 2-3 is opened, a gate of the drainage facility 2-4 is closed, and then a pump of the drainage facility 2-4 is operated to discharge the water stored in the drainage canal 206 into the river 203.

Interchange of water between the rivers 202 and 203 is also realized by controlling the drainage facilities 2-5 and 2-6 provided at both ends of the drainage canal 207 connected between the rivers 202 and 203. For example, when it is desired to transport water reversely, i.e., from the river 202 to the river 203, a gate of the drainage facility 2-6 is opened, a gate of the drainage facility 2-5 is closed, and then a pump of the drainage facility 2-5 is operated to discharge the water stored in the drainage canal 207 into the river 202.

The opening and closing of the gates 2-7 and 2-8 are carried out for the purpose of preventing the reverse flow of the sea water between the rivers 202 and 203 when the tide is at the full, while the drainage facility 2-9 is used to discharge into the river 203 the water such as rain water and foul water or sewage flowing in the drain way 204.

When the river network 201 has risen in water level, for the purpose of coping with the water increase of the drain way 204, the drainage facility 2-9 is operated to discharge the water of the drain way 204 into the river 203.

When the water increase of the river 203 is great and the water level of the river 203 is high, however, the ability of the pump of the drainage facility 2-9 relatively drops and cannot fully discharge or handle the total flow-in water coming from the drain way 204, thus involving a dangerous condition.

In order to avoid such a situation, it becomes necessary to cooperatively operate a plurality of river management facilities in such a manner that the gates of the drainage facilities 2-4 and 2-6 are previously opened to operate the drainage facilities 2-3 and 2-5 to transport the water of the river 203 to the river 202 and to decrease the flow rate of the river 203 in advance.

To this end, it is required, prior to the operation of the river management system, to previously grasp or know relationships between the water level, flow rate and rainfall of rivers and the operations of the respective river management facility devices and also to know rates of change in the water level and flow rate per unit time.

Figure 3:
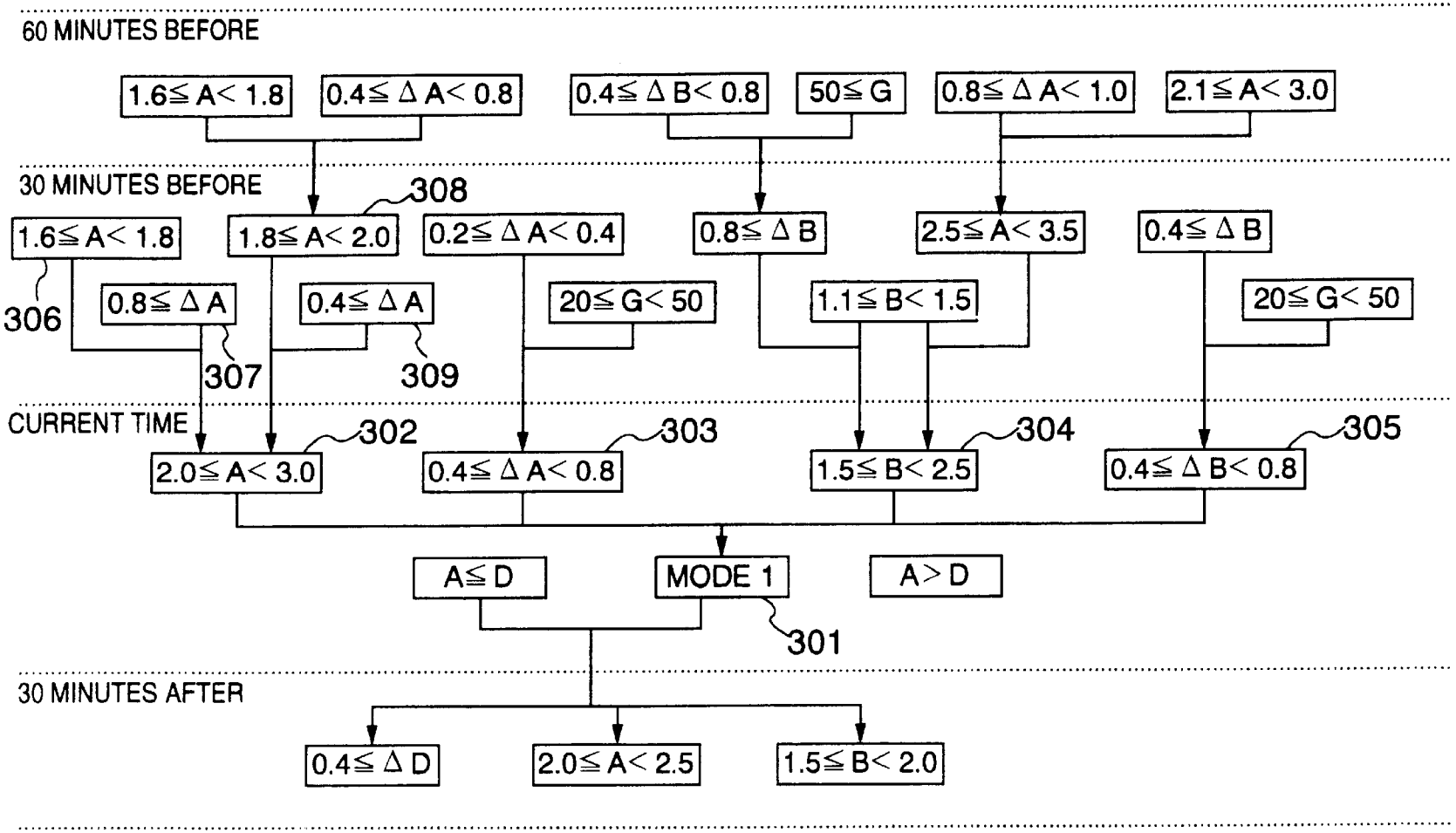
FIG. 3 is a state transition diagram showing an example of river state transition.

FIG. 3 is a state transition diagram showing relationships between water levels at several points in the river network 201, changes in water level rise rate with time, and the operations of the river management facility devices (one of which is indicated by 'mode 1' in the drawing).

(1) Preparing the state transition diagram

Explanation will first be made as to how to prepare the state transition diagram.

The management states of a river network include a plurality of basic patterns including, for example, when rivers are independently managed, when two rivers are managed as cooperatively connected each other at their upstream parts, and when two rivers are managed as cooperatively connected each other at their downstream parts. These patterns will be referred to as operation modes, hereinafter. The river management system is operated always in any one of these operation modes.

Next, such conditions are set as water levels and changes in the water levels at the associated points to determine the respective operation modes. For example, a mode 2 is when two rivers are to be managed as cooperatively connected each other at their upstream parts and when water level rise rate at the upstream parts (points A and B) of the river 202 are relatively high.

Subsequently, the operations of the associated river management facility devices are set for the respective operation modes. In the above mode 2, for example, since it is only required to transport the water upstream of the river 202 to the river 203 via the underground drainage canal 205 and drainage canal 206, the pump of the drainage facility 2-2 as well as the pumps and gates of the drainage facilities 2-3 and 2-4 are operated.

Through the above procedure, the operation modes, conditions for execution of the modes and the operations of the facility devices for the modes have schematically been set. In order to determine specific values for the conditions and device operations, simulation is repetitively carried out. For the simulation technique, a well-known techniques is used as disclosed in a book entitled "A Collection Of Hydraulic Formulas", published from the Japan Society of Civil Engineers, revised in 1971, pp. 180–197.

This water rate prediction simulation is expressed by St. Venant equations (hydraulic model equations), equation of motion (1) and equation of continuity (2), which can also take the influences of combined and branched flows and tidal level into consideration and can take operation rules of the respective river management facility devices, as follows.

$$\frac{1}{gA}\frac{\partial Q}{\partial t}-\frac{2QB}{gA^2}\frac{\partial h}{\partial t}-\frac{Q^2B}{gA^3}\left(I+\frac{\partial h}{\partial x}\right)+\frac{\partial h}{\partial x}+\frac{|Q|Q}{K^2}=0 \quad \text{(Equation 1)}$$

$$\frac{\partial A}{\partial t}+\frac{\partial Q}{\partial x}=0 \quad \text{(Equation 2)}$$

where, $$K^2=(A^2R^{4/3})/n^2,\ R=A/S$$

In the above equations, g is gravity acceleration, I is river bed gradient, A is the cross-sectional area of a water channel, B is the width of the water channel, h is water level, K is sectional conveyance, R is hydraulic mean radius of depth, n is roughness coefficient, S is wetted perimeter, and x is downstream-directed positive distance. The river bed gradient means the gradient of a river bottom, and the roughness coefficient means the resistance coefficient of the river bed. In the equations (1) and (2), Q and h are variables and I and n are actually measured on the river. A, B, R and S are the functions of the variables Q and h.

When the above equation (1) is solved with use of the boundary conditions of an intersection point of the river and drainage canal and the water rate and volume of several points in a situation, flow rates and water levels at positions of each river at different time moments can be computed. The amount of rainfall or precipitation, the height of the movable flashboard and increase in flow rate caused by the operation of the pump are added to the conditions when the equation (1) is solved, flow rates, water levels and changes thereof at the positions of the river under the above conditions can be found.

Such simulation is repeated to shift the current river state to its optimum state as fast as possible. That is, conditions and detailed operations of the facility devices are set and the influences thereof to the river caused by the operations of the facility devices are computed to execute the optimum operation mode. In this connection, consideration is paid not only to the result of the simulation but also to the past actually-measured records about the river network management. In this way, such a state transition diagram as shown in FIG. 3 is prepared for the respective operation modes.

(2) Operation Plan Database and State Transition Database

The operation plan database 104 and state transition database 105 are prepared from the state transition diagram of FIG. 3.

In more detail, such an operation plan database as shown in FIG. 4 is prepared by extracting, from the state transition diagram, conditions for transition to the mode and then setting the extracted conditions and the associated operation mode as one record. For example, the logical "AND" of conditions 302 to 305 in 4 boxes for shifting to the mode 1 (block 301) forms the conditions of one record in FIG. 4.

Shown in FIG. 5 are the operations of the respective facility devices associated with the operation modes, which corresponds to part of the operation plan database 104.

The remaining part of the state transition diagram not described in the above operation plan database 104 is accommodated in the state transition database 105. In FIG. 3, for example, the boxes 301 to 305 have been described in FIG. 4 but all the other boxes must be described in the state transition database. More specifically, the box 302 in FIG. 3 is written in a column of 'after-30-minutes state' in the first record of the state transition database of FIG. 6, whereas the logical "AND" of the conditions of boxes 306 to 309 related to the box 302 is written in a column of the current state in the same record. Similar works to the above are carried out for the other parts and state transition diagrams to prepare the state transition database.

The operation plan database, the correspondence table between the operation modes and the operations of the facility devices, and the state transition database are input to the memory of the river management system body and stored therein.

(3) Operations

Figure 7:
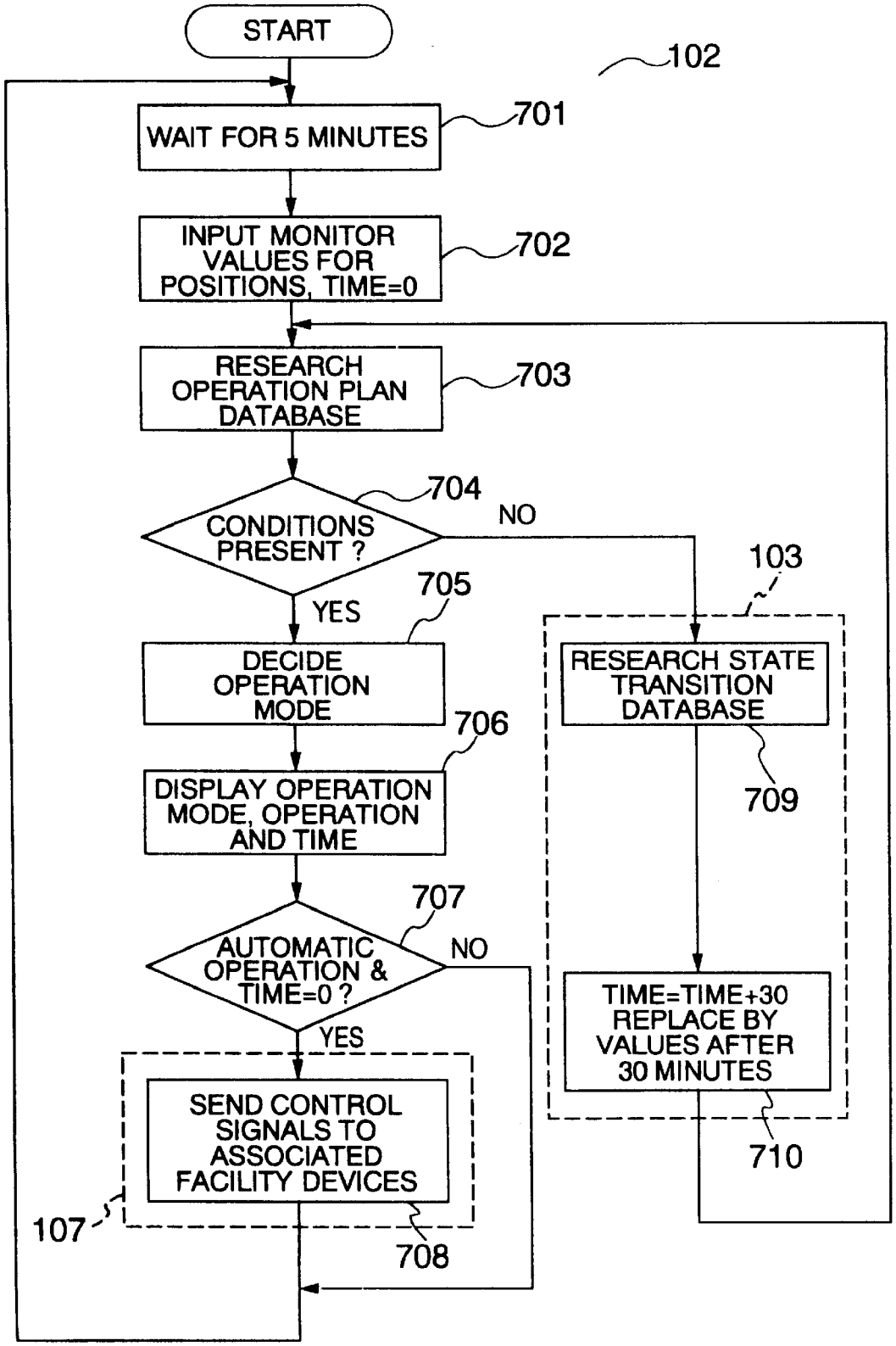
FIG. 7 is a flowchart for explaining the operation of an operation plan decider in the river management system.

The river management system performs its river managing operation by the operation plan decider 102 of the river management system body 101 executing a procedure of FIG. 7.

More in detail, observation or monitor values at various points of rivers are input to the system at intervals of 5 minutes. A variable 'Time' is reset at zero (steps 701 and 702). Water levels, flow rates and precipitations are periodically input from various points to the system so that, when past data are stored for a constant period of time, change rates such as water level rise rate can be obtained.

These monitor values are compared with the conditions of the operation plan database (step 703). In this case, ones of the monitor values not listed in the conditions of the operation plan database are not referred to ('do not care'). The condition items must all be satisfied.

When the monitor values coincide with the conditions, the operation mode corresponding to the conditions is obtained from the database and decided (step 705).

The operation mode thus determined, the operations (FIG. 5) of the facility devices associated with the operation mode, and variable 'Time' are displayed on the console 1-0 of the system body and also on the terminals 1-1 to 1-9 of the respective facilities (step 706). In this conjunction, the display may be carried out so as to display all the operations information on all the terminals as shown in FIG. 5 by 501; or to display all the operations information on only the console of the system body and to display the operations of the devices in one of the facilities on only the associated facility terminal. Further, when the operations of the devices are prescribed with such conditions as given by 502 in FIG. 5, the monitor values input at the step 702 may be used to determine the operations of the devices and display them ('pump start of drainage facility 2-2', for example).

When the system is put in its automatic operational mode and a relationship of 'Time=0' is satisfied (YES at the step 707), control signals for the operations of the devices are sent to the controllers 1-11 to 1-19 of the associated facilities (step 708). As a result, the associated facility devices can be automatically operated in the operation mode.

When the system is not automatically operated (NO at the step 707), an operator stationed at each facility operates the facility devices. When Time=30, the system indicates device operations after 30 minutes, which is convenient when it takes a lot of time to prepare the operations. The 'Time' will be detailed later.

After the system waits for 5 minutes, the system repeats the operations of the step 702 and subsequent steps.

When failing to find any coincidence between the monitor values and the states in the operation plan database 104 (No at the step 704), the system searches the state transition database 105 for them. When finding a coincidence between the monitor values and current states, the system replaces the monitor values by the state values after 30 minutes. For all the records of the state transition database 105, the above check and value replacement are carried out. The variable 'Time' indicates whether the values currently in use are monitor values or the values after 30 minutes. More specifically, when the values currently in use are monitor values, Time=0, while when the values in use are the values after 30 minutes, Time=30. Therefore, when the values used for the research are replaced by the values after 30 minutes, 30 is added to 'Time' (step 710). Researching operation of the operation plan database is carried out again with use of the values after 30 minutes (step 702). When failing to find the corresponding conditions in the operation plan database, the system again researches the state transition database for them and then replaces them by the values after 30 minutes. This works correspond to predicting the states of the rivers after 30 minutes and after one hour to determine its suitable operation mode in the state transition diagram (FIG. 3).

In the flowchart of FIG. 7, the step 708 corresponds to the controller 107 in the river management system body 101, whereas steps 709 and 710 correspond to the state transition predictor 103.

The operation plan decider 102 may be operated at intervals of 5 minutes as shown in FIG. 7 or may be operated only when receiving a request from the operator.

(4) Display

The river management system in accordance with the present invention has a function of displaying how the states of the rivers are changed when the operation mode determined by the operation plan decider 102 is applied to the rivers.

Figure 8:
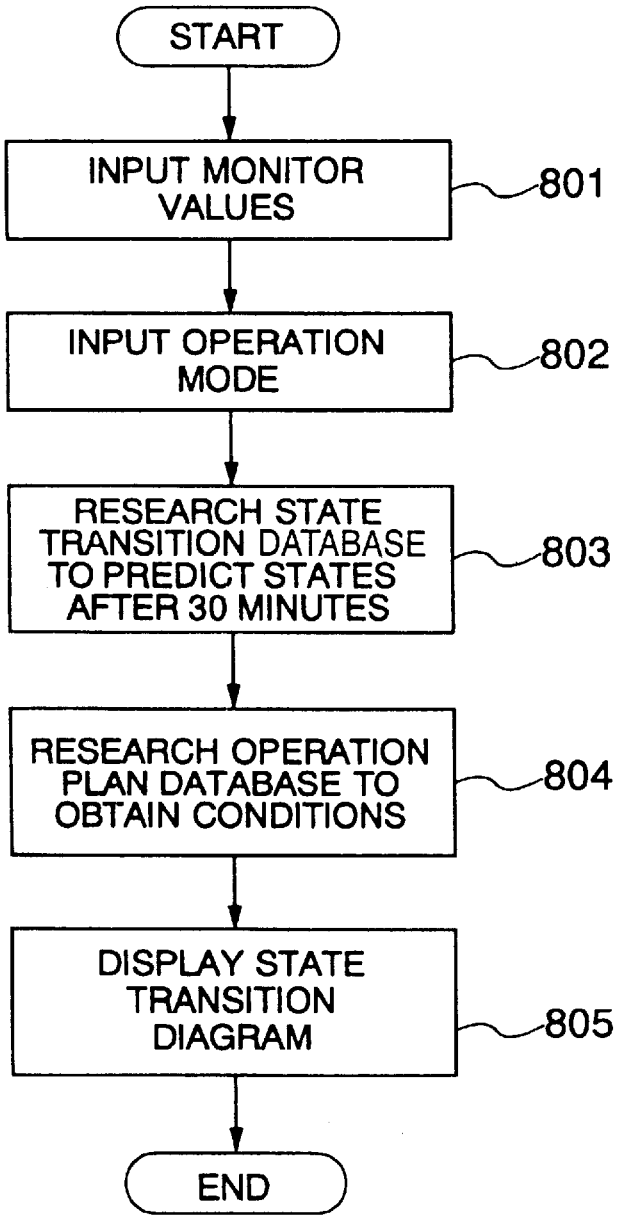
FIG. 8 is a flowchart for explaining the operation of a display unit of the river management system.

FIG. 8 is a flowchart for explaining the operation of the display 106 in the river management system.

The display 106 may be arranged to be operated when receiving a request from the operator or to be automatically operated when the operation plan decider determines the operation mode.

The display 106 receives monitor values (step 801) and then receives the operation mode determined by the operation plan decider (step 802). Subsequently, the display 106 researches the state transition database 105 with use of the monitor values and operation mode to obtain states after 30 minutes (step 803). The display 106 also researches the operation plan database 104 with use of the operation mode to obtain conditions leading to the operation mode (step 804). The display 106 causes the conditions leading to the operation mode and the states after 30 minutes to be displayed on the terminals in the form of a state transition diagram (step 805).

Further, the above display may be effected together with the states before 30 minutes and before one hour. Furthermore, the above display is not limited only to the state transition diagram but may be effected with such a river configuration diagram as shown in FIG. 2 and with the states after 30 minutes being displayed in the form of characters or letters as partly overlapped with the associated positions. In addition, the above display may be effected with the water levels of low, middle and high represented by different colors and with the current water levels or the water levels after 30 minutes represented by colors different for the river divisions.

(5) Modification

The present embodiment uses the water levels, flow rates, precipitations and variations therein obtained from the respective observation points. For such a river that water pollution is severe, it is desirable to draw water from another river into the water-polluted river for the purpose of water clarification. To this end, the river management system of the present invention can be applied to such a situation by monitoring a degree of water pollution, i.e., water clearness, oxygen concentration, chemical substance concentrations, etc. of the river at various observation points thereof and inputting the monitored values to the system to utilize them for cleaning operation of the system.

What is claimed is:

1. A river management system for controllably operating devices of management facilities installed at pluralities of rivers and waterways to manage water volumes in a river network including the pluralities of rivers and waterways, comprising:

an operation plan database for storing (a) river management facility device operation rules corresponding to operation modes, each including physical values at predetermined points and operation states of predetermined river management facility devices as a condition part and operation contents of the river management facility devices as a result part, and (b) meta-rules, each including physical values at predetermined points as a condition part and operation mode as a result part;

monitor/input means for detecting physical values at the predetermined points and operation states of the river management facility devices and inputting the detected values and states to the system; and operation plan decider means for determining the operation mode on the basis of the inputted physical values and said meta-rules and further determining the operation contents on the basis of the inputted physical values and operation states, the determined operation mode and said river management facility device operation rules.

2. A river management system as set forth in claim 1, further comprising device control means for controlling the facility devices installed at said plurality of river management facilities according to the operation contents determined by said operation plan decider means.

3. A river management system as set forth in claim 1, wherein said monitor/input means inputs to said system the values of water levels, flow rates and precipitations at the respective points of said river network as well as rates of change thereof, said operation plan database has information on said change rates in addition to the values of water levels, flow rate and precipitations of the respective points of said river network, and said operation plan decider means uses said change rates.

4. A river management system as set forth in claim 1, wherein said monitor/input means monitors, in addition to the values of water levels, flow rates and precipitations at the respective points of said river network, degrees of water pollution at the points and inputs the water pollution degrees to said system, said operation plan database has information on said water pollution degrees in addition to the values of water levels, flow rate and precipitations of the respective points of said river network, and said operation plan decider means uses said water pollution degrees.

5. A river management system as set forth in claim 1, further comprising:

a state transition database for storing therein a plurality of sets of the physical values at predetermined points, the operation mode, and corresponding physical values after passage of a predetermined time; and state transition predictor means for researching said state transition database on the basis of the physical values and the operation mode to predict physical values after passage of a predetermined time.

6. A river management system as set forth in claim 5, further comprising:

device control means for controlling the facility devices installed at said plurality of river management facilities according to the operation contents determined by said operation plan decider means.

7. A river management system as set forth in claim 5, wherein said operation plan decider means determines operation contents of said river management facility devices after passage of the predetermined time with use of the predicted physical values.

8. A river management system as set forth in claim 5, further comprising display means for obtaining relationships among the physical values at predetermined points, the operation mode, and the physical values at predetermined points after passage of the predetermined time from said operation plan database and said state transition database and displaying said relationships.

9. A river management system as set forth in claim 5, wherein the physical value at predetermined points is at least one of water level, flow rate, precipitation, water pollution degree, and their change rates at the predetermined points.

10. A river management system for controllably operating devices of management facilities installed at pluralities of rivers and waterways to manage water volumes in a river network including the pluralities of rivers and waterways, comprising:

an operation plan database for storing therein a plurality of sets of conditions of values of water levels, flow rates and precipitation at a plurality of points in said river network and contents of corresponding operations of said river management facility devices;

monitor/input means for detecting the water levels, flow rates and precipitations at the plurality of points of the river network, converting the detected values to digital values and then inputting the digital values to the system;

operation plan decider means for determining and displaying the operation contents of said river management facility devices on the basis of the values of the water levels, flow rates and precipitations at the plurality of points of the river network input from said monitor/input means and on the basis of said operation plan database;

a state transition database for storing therein a plurality of sets of the values of water levels, flow rates and precipitation at the plurality of points of said river network, said operation contents of said river management facility devices, and values of water levels and flow rates at the plurality of points of the river network after passage of a predetermined time; and state transition predictor means for researching said state transition database on the basis of the values of water levels, flow rates and precipitations at the plurality of points of said river network and on the basis of the operation contents of said river management facility devices to predict values of the water levels and flow rates after passage of the predetermined time.

11. A river management system as set forth in claim 10, further comprising device control means for controlling the facility devices installed at said plurality of river management facilities according to the operation contents determined by said operation plan decider means.

12. A river management system as set forth in claim 10, wherein said operation plan decider means determines operation contents of said river management facility devices after passage of the predetermined time with use of the predicted values of water levels and flow rates after passage of the predetermined time predicted by said state transition predictor means.

13. A river management system as set forth in claim 10, further comprising display means for obtaining relationships among the values of water levels, flow rates and precipitations at the plurality of points of said river network, the operation contents of said river management facility devices, and values of water levels and flow rates at the points of the river network after passage of the predetermined time from said operation plan database and said state transition database and displaying said relationships.

14. A river management method in a river network including pluralities of rivers and waterways for determining operations of devices in a plurality of river management facilities to manage water volumes in the river network, comprising the steps of:

preparing an operation plan database for storing therein a plurality of sets of conditions of values of water levels, flow rates and precipitations at a plurality of points in said river network and contents of corresponding operations of said river management facility devices;

preparing a state transition database for storing therein a plurality of sets of the values of water levels, flow rates and precipitations at the plurality of points in the river network, the operation contents of said river management facility devices, and values of water levels and flow rates at the plurality points of said river network after passage of a predetermined time;

detecting values of water levels, flow rates and precipitations at the respective points of said river network;

determining operation contents of said river management facility devices on the basis of the values of water levels, flow rates and precipitations at the points of said river network and on the basis of said operation plan database; and researching said state transition database with use of the values of water levels, flow rates and precipitations at the respective points of said river network and the operation contents of said river management facility devices to predict values of water levels and flow rates of the respective points of said river network after passage of the predetermined time.

15. A river management method as set forth in claim 14, further comprising the step of performing simulation with use of a configuration of said river network, actually-measured past data of the river network and St. Venant equations to find values of water levels, flow rates and precipitations at the respective points of the river network, operation procedures of said river management facility devices to keep the water volumes of the river network at suitable levels, and water levels and flow rates at the respective points of the river network after passage of a predetermined time to prepare a state transition diagram of the river network, and wherein said operation plan database and said state transition database are prepared based on said state transition diagram.

16. A river management method in a river network including pluralities of rivers and waterways for determining operations of devices in a plurality of river management facilities to manage water volumes in the river network, comprising the steps of:

providing river management facility device operation rules corresponding to operation modes, each including physical values at predetermined points and operation states of predetermined river management facilities as a condition part and operation contents of the river management facility devices as a result part;

providing meta-rules, each including predetermined physical values at predetermined points as a condition part and operation mode as a result part;

providing state transition database for storing therein a plurality of sets of the physical values at predetermined points, the operation mode and corresponding physical values after passage of a predetermined time;

detecting physical values at the predetermined points and operation states of the river management facility devices;

determining the operation mode on the basis of the inputted physical values and said meta-rules;

determining the operation contents on the basis of the detected physical values and operation states, the determined operation mode, and said river management facility device operation rules; and researching said state transition database on the basis of the physical values and the operation mode to predict values of the physical values after passage of a predetermined time; and determining the operation on the basis of the predicted values.

17. A river management method as set forth in claim 16, further comprising the step of performing simulation with use of a configuration of said river network, actually-measured past data of the river network and St. Venant equations to find a plurality of sets of physical values at predetermined points after passage of a predetermined time, operation contents of said river management facility devices to prepare a state transition diagram of the river network, and wherein said river management facility device operation rule, said meta rule, and said state transition database are prepared based on said state transition diagram.

18. A river management method as set forth in claim 16, wherein the physical value at predetermined points is at least one of water level, flow rate, precipitation, water pollution degree, and their change rates at the predetermined points.

* * * * *